US007520589B2

(12) United States Patent
Sakurai

(10) Patent No.: US 7,520,589 B2
(45) Date of Patent: Apr. 21, 2009

(54) INK-JET RECORDING APPARATUS AND CLEANING BLADE

(75) Inventor: Hisaki Sakurai, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 401 days.

(21) Appl. No.: 11/438,318

(22) Filed: May 23, 2006

(65) Prior Publication Data

US 2006/0262159 A1 Nov. 23, 2006

(30) Foreign Application Priority Data

May 23, 2005 (JP) ..... 2005-149412

(51) Int. Cl.
*B41J 2/165* (2006.01)

(52) U.S. Cl. ..... 347/33

(58) Field of Classification Search ..... 347/33, 347/29, 32, 28, 24
See application file for complete search history.

(56) References Cited

U.S. PATENT DOCUMENTS 6,669,328 B2 * 12/2003 Lin ..... 347/33
6,752,487 B1 6/2004 Kubota et al.

FOREIGN PATENT DOCUMENTS

JP 2004 105597 4/2001
JP 2004 168002 6/2004

* cited by examiner

*Primary Examiner*—Shih-Wen Hsieh
(74) *Attorney, Agent, or Firm*—Baker Botts, LLP

(57) ABSTRACT

A cleaning blade for wiping ink adhering to an ink ejection surface of an ink-jet head in which nozzles are formed by a relative movement of the cleaning blade and the ink ejection surface with the cleaning blade held in contact with the ink ejection surface, wherein the cleaning blade has a surface having: a first region which is located near to the ink ejection surface and which has a first degree of water repellency; and a second region which is contiguous to the first region and located away from the ink ejection surface and which has a second degree of water repellency that is lower than the first degree of water repellency, and wherein a boundary line which constitutes a boundary between the first region and the second region has at least one oblique portion each of which is inclined with respect to a straight line that is orthogonal to the ink ejection surface.

10 Claims, 11 Drawing Sheets

INK-JET RECORDING APPARATUS AND CLEANING BLADE

The present application is based on Japanese Patent Application No. 2005-149412 filed on May 23, 2005, the contents of which are incorporated herein by reference.

BACKGROUND OF THE INVENTION

1. Field of the Invention

The present invention relates in general to an ink-jet recording apparatus which performs printing by ejecting ink to a recording medium and a cleaning blade which wipes ink adhering to an ink ejection surface.

2. Discussion of Related Art

JP-A-2001-105597 discloses a liquid discharging apparatus in which ink adhering to a face surface (an ink discharging surface) of a liquid discharging head (an ink-jet head) is wiped by moving the liquid discharging head with the face surface held in contact with a top end of a cleaning blade. In the disclosed liquid discharging apparatus, the cleaning blade has a smooth water-repellent film with a substantially uniform thickness formed on its outer surface. The water-repellent film formed on the cleaning blade is effective to prevent the base material of the cleaning blade from being changed in quality by the ink wiped away from the face surface.

In the liquid discharging apparatus disclosed in the above-indicated Publication JP-A-2001-105597, however, the water-repellent film of the cleaning blade has the same degree of water-repellent property at any position of the outer surface of the cleaning blade. Because the ink adhered to the top end of the cleaning blade moves on the surface of the cleaning blade in a direction away from the top end by its own weight, there may be a risk that the ink remains in the vicinity of the top end of the cleaning blade.

In the meantime, JP-A-2004-168002 discloses an ink-jet recording apparatus in which an absorbable member is disposed on a surface of a cleaning blade with water-repellent property, which surface is to be in contact with a nozzle surface (an ink discharging surface) of an ink-jet head. The ink adhered to the nozzle surface is scraped by the cleaning blade, and the scraped ink is absorbed by the absorbable member.

SUMMARY OF THE INVENTION

In the ink-jet recording apparatus disclosed in JP-A-2004-168002, however, the ink scraped by the cleaning blade is not absorbed by the absorbable member until the ink moves to an upper end face of the absorbable member. Because the upper end face of the absorbable member is parallel to the nozzle surface, a boundary line between the surface of the cleaning blade that is to be in contact with the nozzle surface and the upper end face of the absorbable member is a straight line which is parallel to the plane of the nozzle surface. Where the boundary line is constituted by such a mere straight line as described above, there is a little chance that the ink scraped by the cleaning blade comes into contact with the boundary line. Therefore, the ink scraped by the cleaning blade does not positively move from the top end of the cleaning blade, resulting in a high possibility that the ink remains in the vicinity of the top end of the cleaning blade. Where the ink remaining in the vicinity of the top end solidifies or thickens due to drying, the solidified or thickened ink adheres back to the nozzle surface when the cleaning blade again scrapes ink adhering to the nozzle surface, giving adverse influence on the ink ejecting characteristics.

It is therefore an object of the present invention to provide an ink-jet recording apparatus and a cleaning blade capable of effectively cleaning an ink ejection surface.

To achieve the above-indicated object, the present invention provides a cleaning blade for wiping ink adhering to an ink ejection surface of an ink-jet head in which nozzles are formed by a relative movement of the cleaning blade and the ink ejection surface with the cleaning blade held in contact with the ink ejection surface, wherein the cleaning; blade has a surface having: a first region which is located near to the ink ejection surface and which has a first degree of water repellency; and a second region which is contiguous to the first region and located away from the ink ejection surface and which has a second degree of water repellency that is lower than the first degree of water repellency, and wherein a boundary line which constitutes a boundary between the first region and the second region has at least one oblique portion each of which is inclined with respect to a straight line that is orthogonal to the ink ejection surface.

In the cleaning blade constructed as described above, the boundary line is longer on the surface of the blade than a straight line that is parallel to the ink ejection surface, whereby the ink which moves from the ink ejection surface to the first region as a result of wiping of the ink adhering to the ink ejection surface by the cleaning blade is likely to come into contact with the second region at the long boundary line. Accordingly, the ink in the first region tends to easily move to the second region, so that the ink which has attached to the first region by the wiping operation of the cleaning blade is less likely to stay in the first region. In consequence, there is little chance that the ink stays in the first region and solidifies or thickens due to drying. Therefore, it is possible to prevent solidified or thickened ink from adhering to the ink ejection surface when the ink ejection surface is again wiped by the cleaning blade.

To achieve the above-indicated object, the present invention also provides an ink-jet recording apparatus comprising: an ink-jet head having an ink ejection surface in which are formed nozzles for ejecting ink; and a cleaning device which wipes ink adhering to the ink ejection surface of the ink-jet head and which includes: a cleaning blade arranged to come into contact with the ink ejection surface; and a moving mechanism which moves the cleaning blade and the ink ejection surface relative to each other in a state in which the cleaning blade and the ink ejecting surface are held in contact with each other, wherein the cleaning blade has a surface having: a first region which is located near to the ink ejection surface and which has a first degree of water repellency; and a second region which is contiguous to the first region and located away from the ink ejection surface and which has a second degree of water repellency that is lower than the first degree of water repellency, and wherein a boundary line which constitutes a boundary between the first region and the second region has at least one oblique portion each of which is inclined with respect to a straight line that is orthogonal to the ink ejection surface.

The present ink-jet recording apparatus enjoys the effect similar to that described above with respect to the cleaning blade of the present invention.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
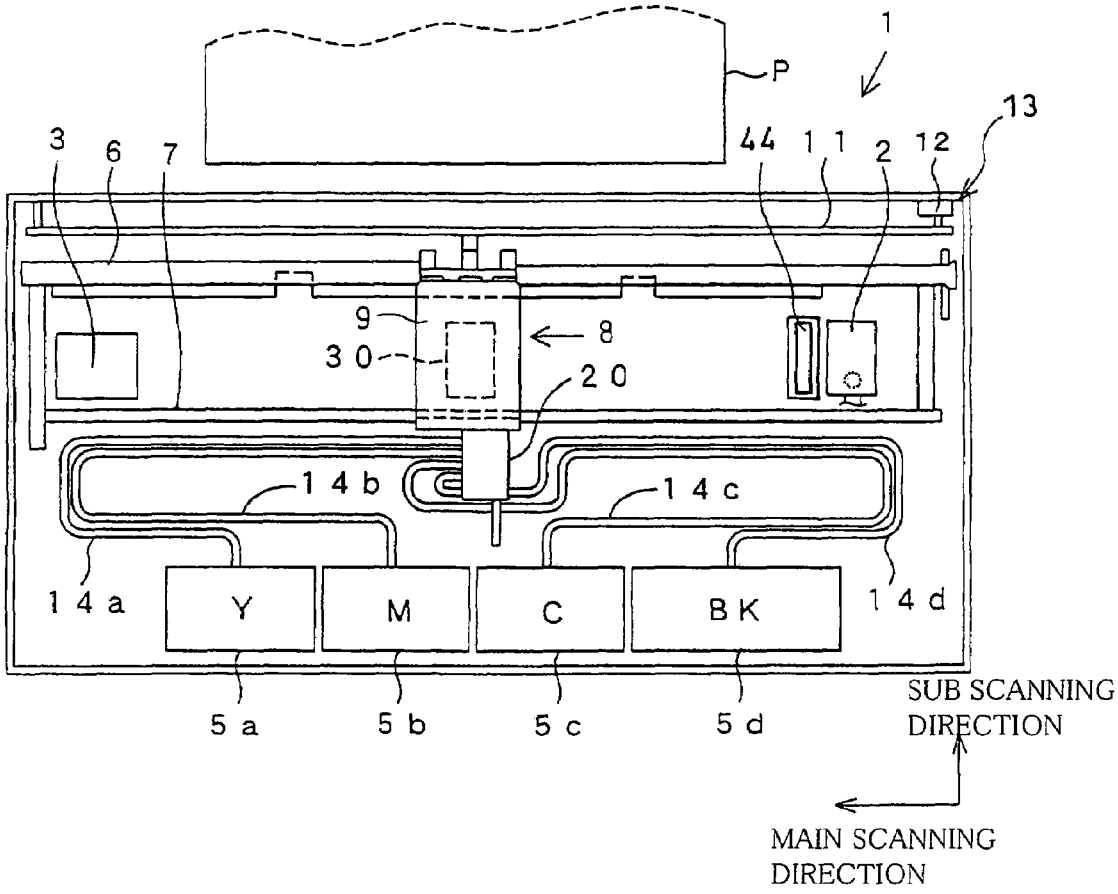
FIG. 1 is a plan view schematically showing an ink-jet printer which employs a cleaning blade constructed according to a first embodiment of the present invention.

By referring to the drawings, there will be described preferred embodiments of the present invention.

FIG. 1 is a plan view schematically showing an ink-jet printer which employs a cleaning blade constructed according to a first embodiment of the present invention. In an inside of the ink-jet printer (an ink-jet recording apparatus) indicated at 1 in FIG. 1, two guide shafts 6, 7 are disposed. To these guide shafts 6, 7, there is attached a head unit 8 functioning also as a carriage. The head unit 8 has a head holder 9 made of a synthetic resin material. The head holder 9 holds an ink-jet head 30 which performs printing by ejecting ink to a sheet of paper (a recording sheet) P. The ink-jet head 30 has an ink ejection surface 25*a* which is to be opposed to the recording sheet P and in which are formed a plurality of nozzles 28. The ink-jet printer 1 has a moving mechanism 13 including a carriage motor 12 and an endless belt 11 which is rotated by the carriage motor 12. The head holder 9 is attached to the endless belt 11 and reciprocated in a main scanning direction along the guide shafts 6, 7 by driving of the carriage motor 12.

The ink-jet printer 1 has ink cartridges 5*a*-5*d* respectively accommodating yellow ink, magenta ink, cyan ink and black ink. The ink cartridges 5*a*-5*d* are connected to a tube joint 20 through respective flexible tubes 14*a*-14*d*.

The ink-jet printer 1 is equipped with an ink absorbing member 3 which is to be opposed to the head holder 9 when the head holder 9 is moved to a left-side end of the ink-jet printer 1. The ink absorbing member 3 absorbs ink ejected from the nozzles 28 upon flushing. The ink-jet printer 1 is further equipped with a purge device 2 which is to be opposed to the head holder 9 when the head holder 9 is moved to a right-side end of the ink-jet printer 1. The purge device 2 is for forcibly sucking, from the nozzles, air bubbles and dusts accumulated in the ink-jet head 30, together with ink.

On a left side of the purge device 2, there is disposed a cleaning blade 44 which wipes ink that adheres to the ink ejection surface 25*a* as a result of ejection of ink by the purge device 2. The cleaning blade 44 according to the first embodiment is arranged to be moved by a raising and lowering mechanism not shown in a direction toward the ink ejection surface 25*a* when the head unit 8 is located at a position at which the head unit 8 is opposed to the cleaning blade 44 and a left end of the ink ejection surface 25*a*. With a top end of the cleaning blade 44 held in contact with the ink ejection surface 25, the head unit 8 is moved in a leftward direction (i.e., a direction parallel to the main scanning direction) by driving of the carriage motor 12 of the moving mechanism 13, whereby the ink adhering to the ink ejection surface 25*a* is wiped by the cleaning blade 44. The details of the blade 44 will be explained.

Figure 2:
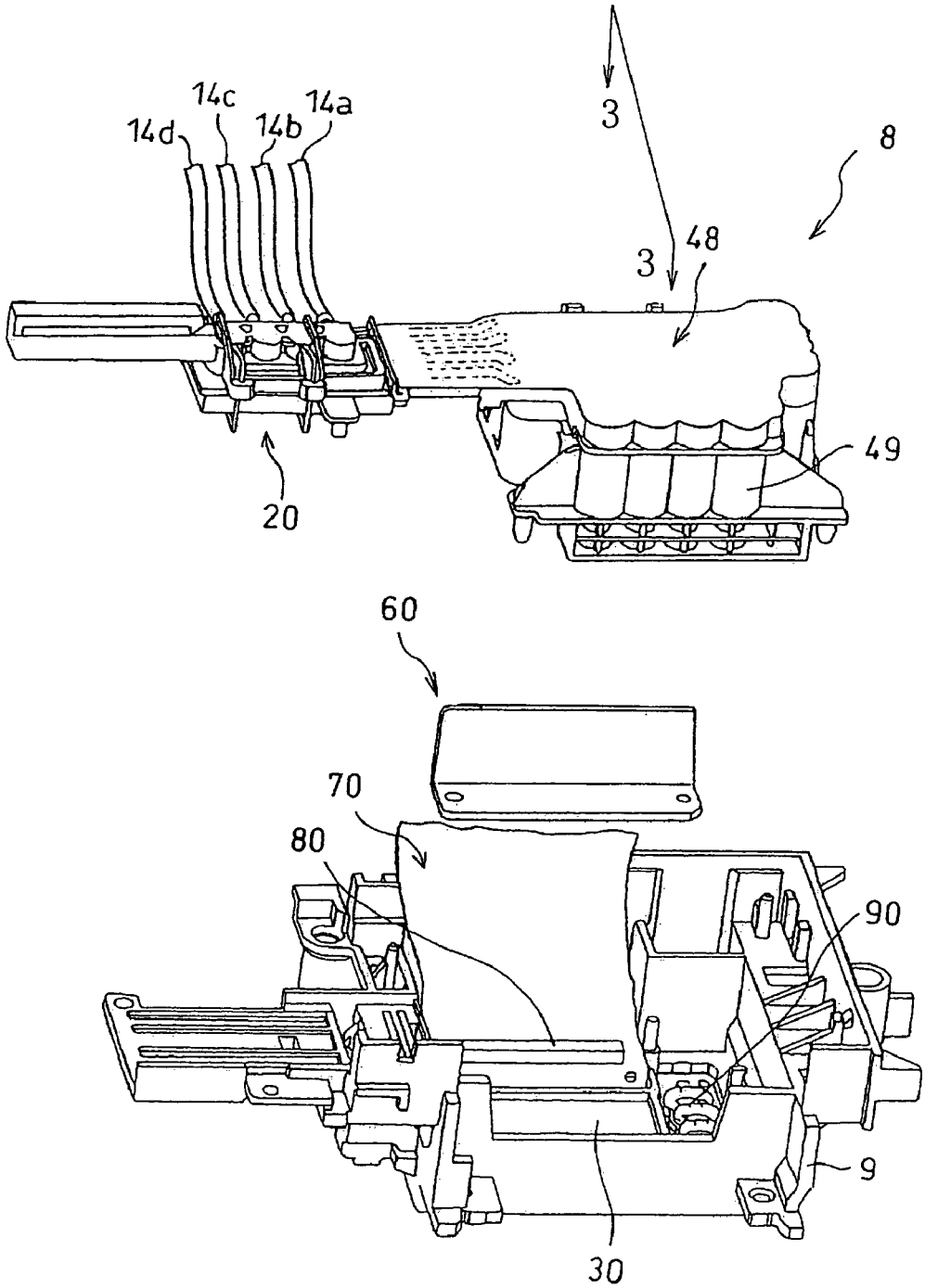
FIG. 2 is an exploded perspective view showing a head unit of the ink-jet printer of FIG. 1.
Figure 3:
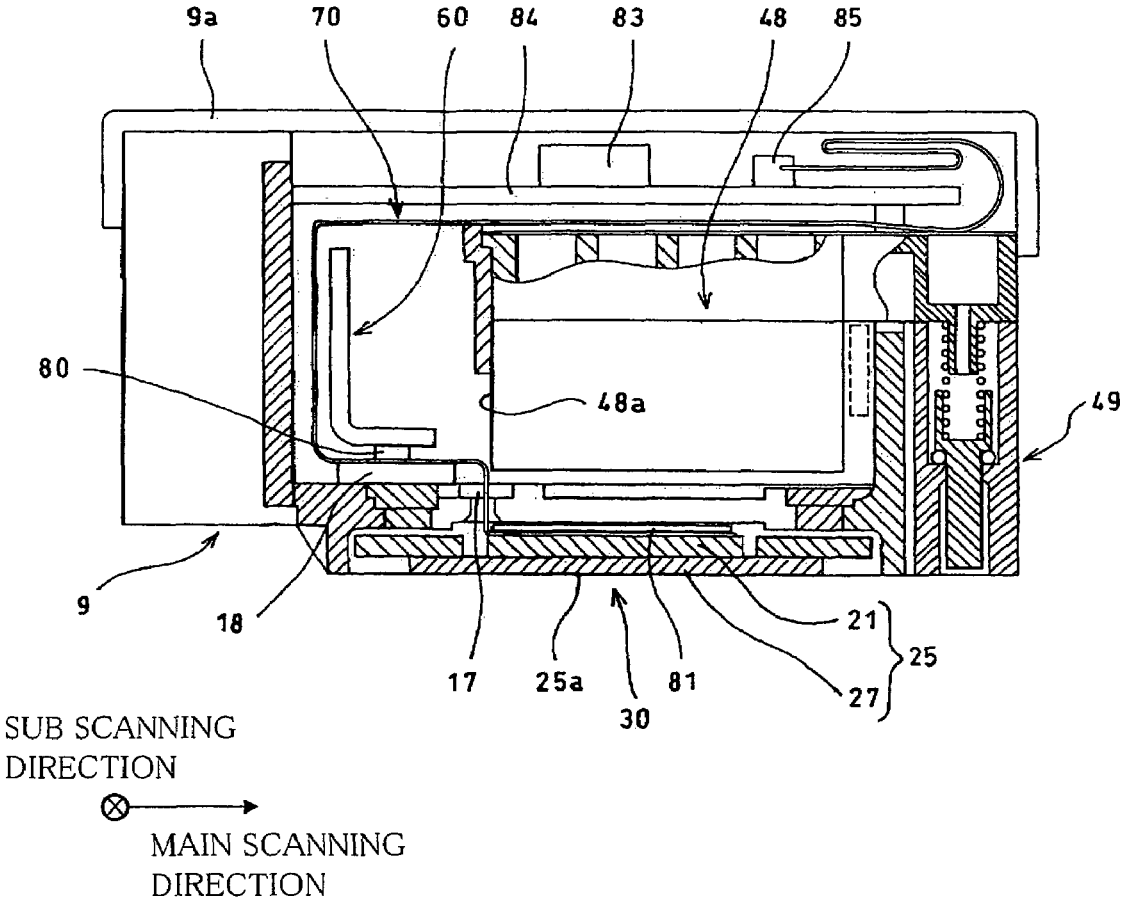
FIG. 3 is an elevational view in vertical cross section showing the ink-jet head unit of FIG. 2.

Next, there will be explained a principal structure of the head unit 8. FIG. 2 is an exploded perspective view of the head unit 8 shown in FIG. 1 in which a buffer tank 48 and a heat sink 60 are removed from the head holder 9. FIG. 3 is a vertical cross sectional view of the head unit 8 shown in FIG. 2 taken along line 3-3 of FIG. 2. In FIG. 3, there are illustrated a control substrate 84 and a cover 9*a* above the buffer tank 48 which are not illustrated in FIG. 2.

As shown in FIGS. 2 and 3, the head holder 9 has a generally box-like configuration opening upwards, and a head main body 25 that constitutes the ink-jet head 30 is fixed to a bottom portion of the head holder 9. In the head holder 9, the buffer tank 48 for temporarily storing ink to be supplied to the head main body 25 is disposed above the head main body 25. The head main body 25 is disposed such that its bottom surface (the ink ejection surface 25*a*) is exposed to an outside (an underside) of the head holder 9.

As shown in FIG. 2, the tube joint 20 is connected to one of opposite end portions of the buffer tank 48 for supplying ink to the same 48. Four ink outlets (not shown) are formed in a lower surface of the other of the opposite end portions of the buffer tank 48 and are connected via a sealing member 90 to respective four ink supply holes 30*a* (which will be described) formed in the head main body 25. Above the buffer tank 48, the control substrate 84 is disposed on which electronic components such as a condenser 83 and a connector 85 are mounted. The cover 9*a* covers an upper portion of the head holder 9 over the control substrate 84.

As shown in FIG. 3, the heat sink 60 having an L-shaped configuration is fixed to the head holder 9 at a position adjacent to a left side wall 48*a* of the buffer tank 48. On a right side of the buffer tank 48, there is disposed an air-discharge device 49 which discharges air accumulated in the buffer tank 48 into an exterior.

Figure 4:
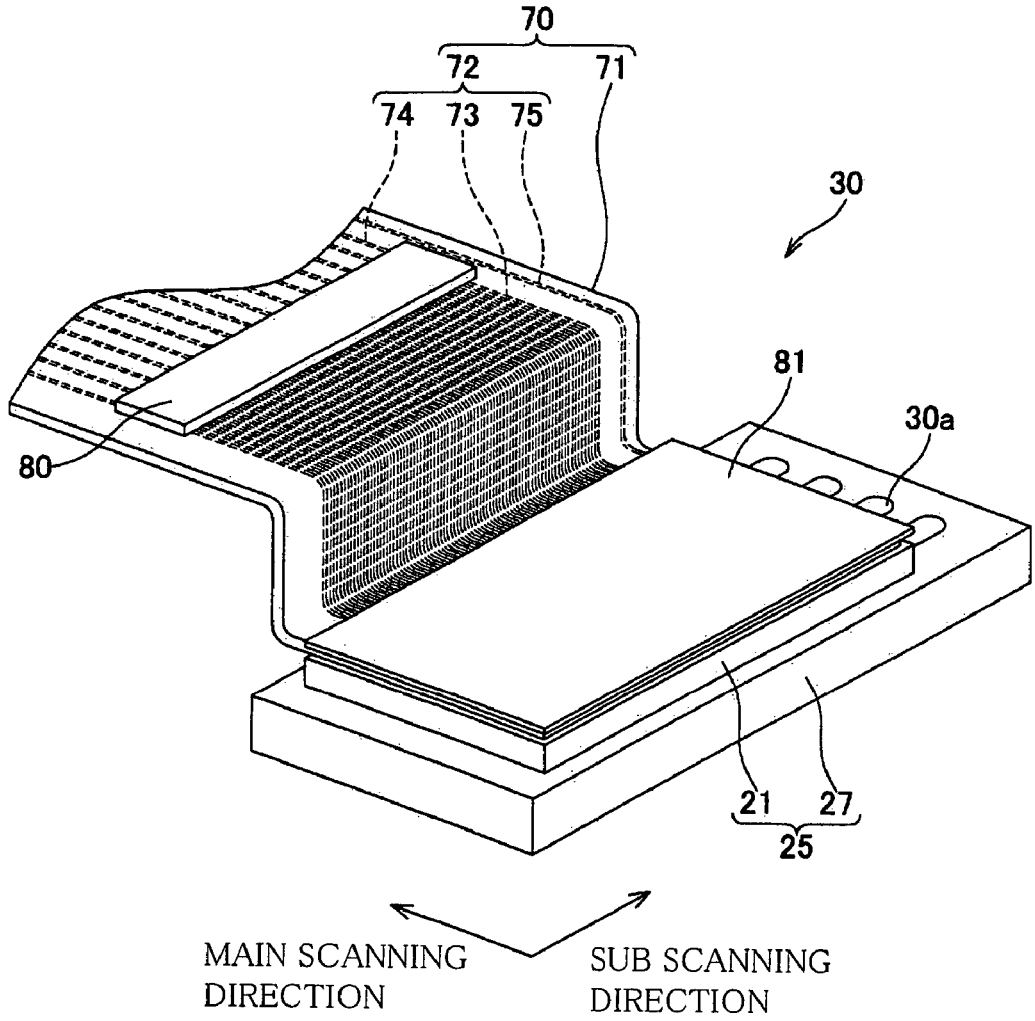
FIG. 4 is a perspective outside view of an ink-jet head according to the first embodiment of the present invention.
Figure 5:
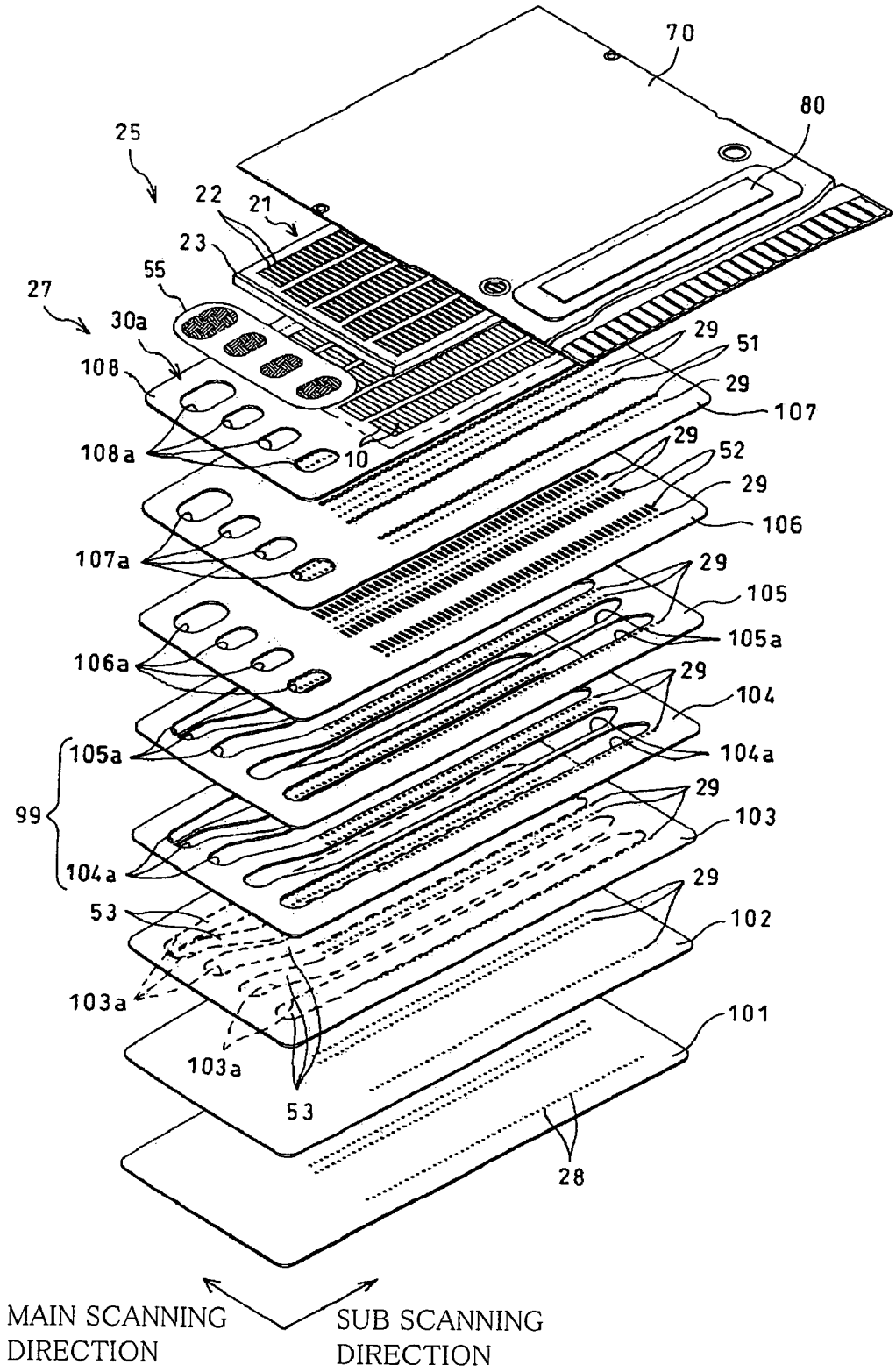
FIG. 5 is an exploded perspective view of a head main body and an FPC shown in FIG. 4.

Next, there will be explained a principal structure of the ink-jet head 30. FIG. 4 is an exploded outside view of the ink-jet head 30. As shown in FIGS. 3 and 4, the ink-jet head 30 includes the head main body 25 and an FPC (Flexible Printed Circuit) 70 bonded to the upper surface of the head main body 25. The head main body 25 includes a channel unit 27 in which a plurality of ink channels are formed for the respective four colors of ink and a piezoelectric actuator 21 which is bonded to the upper surface of the channel unit 27 by a thermosetting adhesive agent. Each of the channel unit 27 and the piezoelectric actuator 21 has a laminar structure in which a plurality of thin plates each having a rectangular flat shape are stacked on each other. The channel unit 27 and the piezoelectric actuator 21 are both disposed below the buffer tank 48. The four ink supply holes 30*a* each having an elliptical shape in plan view are formed on the upper surface of the channel unit 27 except a portion thereof on which the piezoelectric actuator 21 are provided. In a region in which the four ink supply holes 30*a* are formed, there is disposed a filter 55 as shown in FIG. 5 in which a plurality of minute holes are formed at positions opposing to the ink supply holes 30*a*. The ink which flows from the ink outlets (not shown) of the buffer tank 48 is passed through the filter 55 and is introduced into the channel unit 27 from the ink supply holes 30*a*.

As shown in FIG. 4, the FPC 70 includes a flexible insulating base member 71 which extends from the piezoelectric actuator 21 to the control substrate 84 and a plurality of wires 72 which are formed along a direction in which the base member 71 extends. A driver IC 80 is mounted on the base member 71. The plurality of wires 72 include: a plurality of individual wires 73 which respectively connect a plurality of individual electrodes 37 (that will be described) formed on the piezoelectric actuator 21 electrically to the driver IC 80; a plurality of signal wires 74 which electrically connect the driver IC 80 and the control substrate 84 to each other; and a common wire 75 which connects a common electrode 38 (that will be described) formed on the piezoelectric actuator 21 to the ground. The FPC 70 is pulled out from the upper surface of the piezoelectric actuator 21 to one side of the head main body 25 in the main scanning direction, passed through a hole 17 formed in the bottom portion of the head holder 9, and extends upwards through a gap formed between the heat sink 60 and a side wall of the head holder 9, as shown in FIG. 3. The FPC 70 is electrically connected to the connector 85 provided on the control substrate 84 through a gap between the control substrate 84 and the buffer tank 48. The driver IC 80 converts a print signal serially transmitted from the control substrate 84 into drive signals which are parallel signals with suitable voltages, and outputs the drive signals to the respective individual electrodes 37 via the respective individual wires 73. The drive IC 80 is pressed by an elastic member 18 so as to be in contact with the heat sink 60. Thus, excessive heat generated by the driver IC 80 is dissipated.

At a portion of the FPC 70 which is opposed to the piezoelectric actuator 21, there is disposed an aluminum plate 81 which has a rectangular flat shape having substantially the same size as the upper surface of the piezoelectric actuator 21 and which makes heat generated by operating the piezoelectric actuator 21 uniform among the individual electrodes 37.

FIG. 5 is an exploded perspective view of the main head body 25 and the FPC 70. As shown in FIG. 5, the channel unit 27 has a laminar structure in which the following eight sheet members are stacked on each other in order from the top: a cavity plate 108; a supply plate 104; an aperture plate 106; upper and lower manifold plates 104, 105; a damper plate 103; a cover plate 102; and a nozzle plate 101. Each plate 101-108 has a rectangular flat shape which is long in a sub scanning direction. In the present embodiment, among the eight plates 101-108 constituting the channel unit 27, seven plates 102-108 except the nozzle plate 101 are formed of a stainless steel and the nozzle plate 101 is formed of a polyimide resin.

In the nozzle plate 101, the multiplicity of nozzles 28 each having an extremely small diameter are formed at minute intervals. The nozzles 28 are arranged in five rows in a zigzag fashion along a longitudinal direction of the nozzle plate 101 (i.e., along the sub scanning direction).

In the cavity plate 108, a plurality of pressure chambers 10 respectively corresponding to the nozzles 28 are formed in five rows in a zigzag fashion along a longitudinal direction of the cavity plate 108. A longitudinal direction of each pressure chamber 10 corresponds to the main scanning direction and is perpendicular to the longitudinal direction of the cavity plate 108. One of opposite ends of each pressure chamber 10 communicates with the corresponding nozzle 28 of the nozzle plate 101 via through-holes 29, each of which has a minute diameter and which are formed in the supply plates 107, the aperture plate 106, the upper and lower manifold plates 104, 105, the damper plate 103 and the cover plate 102, respectively, so as to be arranged in a zigzag fashion. The other of the opposite ends of each pressure chamber 10 communicates with a corresponding one of five half ink chambers 105*a* (a corresponding one of five common ink chambers 99) via a corresponding communication hole 51 of the supply plate 107 and a corresponding aperture 52 of the aperture plate 106. Further, at one longitudinal end portion of the cavity plate 108, there are formed four holes 108*a* respectively giving the four ink supply holes 30*a*, such that the four holes 108*a* are spaced apart from each other in a width direction of the cavity plate 108 (i.e., in the main scanning direction).

As shown in FIG. 5, in the upper manifold plate 105 nearer to the aperture plate 106, the five half ink chambers 105*a* are formed through the thickness of the upper manifold plate 105. The five half ink chambers 105*a* extend along a longitudinal direction of the upper manifold plate 105 and are spaced apart from each other in a width direction of the same 105.

In the lower manifold plate 104 nearer to the damper plate 103, five half ink chambers 104*a*similar to the five half ink chambers 105*a* are formed through the thickness of the lower manifold plate 104. When the lower and upper manifold plates 104, 105, the aperture plate 106 and the damper plate 103 are stacked on each other, the half ink chambers 104*a* of the lower manifold plate 104 and the half ink chambers 105*a* of the upper manifold plate 105 which are opposed to each other are connected, and upper and lower open ends of the connected half ink chambers 104*a*, 105*a* are closed by the aperture plate 106 and the damper plate 103, respectively. According to this arrangement, the five common ink chambers 99 are formed in-between and outside of the rows of the through-holes 29. One end of each common ink chamber 99 is opposed to the corresponding ink supply hole 30*a*.

The plurality of communication holes 51 formed through the thickness of the supply plate 107 are arranged in five rows in a zigzag fashion along a longitudinal direction of the supply plate 107 so as to correspond to the respective pressure chambers 10. The supply plate 107 has, at one longitudinal end thereof, four holes 107*a* which are formed so as to be opposed to the respective four holes 108*a* of the cavity plate 108.

In addition to the through-holes 29, a plurality of apertures 52 are formed in the aperture plate 106. Each aperture 52 extends in a width direction of the aperture plate 106 and has a generally rectangular flat shape. The apertures 52 are arranged in five rows in a zigzag fashion along a longitudinal direction of the aperture plate 106. Each aperture 52 communicates at one end thereof with a corresponding one of the communication holes 51 and at the other end thereof with a corresponding one of the common ink chambers 99.

The leftmost one 106*a* of the four holes 106*a* of the aperture plate 106 as seen in FIG. 5 is in communication with the first and second common ink chambers 99 from the left as seen in FIG. 5 while the rest of the holes 106*a* are respectively in communication with the first through third common ink chambers 99 from the right as seen in FIG. 5. Namely, to both of the first and second common ink chambers 99 from the left as seen in FIG. 5, the ink is supplied from a corresponding one of the four ink supply holes 30*a* while, to each of the rest (three) of the common ink chambers 99, the ink is supplied from a corresponding one of the rest (three) of the ink supply holes 30*a*. In the present embodiment, the black ink is supplied to the first and second common ink chambers 99 from the left as seen in FIG. 5. Further, the yellow ink, the magenta ink and the cyan ink are respectively supplied to the first, second and third common ink chambers 99 from the right as seen in FIG. 5.

In the damper plate 103, there are formed five rows of damper grooves 103*a* as shown in FIG. 5. The damper grooves 103*a* are open only toward the cover plate 102, aligned with the respective common ink chambers 99, and identical in configuration with the common ink chambers 99. Accordingly, when the lower and upper manifold plates 104, 105 and the damper plate 103 are stacked on each other, there are formed damper portions 53 each of which is located at a position of the damper plate 103 that faces the corresponding common ink chamber 99. Here, the damper portion 53 is constituted as a bottom surface of the damper groove 103*a* which is formed to be elastically deformable, whereby the damper portion 53 can freely oscillate toward the corresponding common ink chamber 99 and toward the corresponding damper groove 103*a*. According to the structure, even when pressure variation generated in the pressure chambers 10 upon ejection of the ink is propagated to the corresponding common ink chamber 99, such pressure variation can be absorbed and damped by elastic deformation of the damper portion 53.

In the thus constructed channel unit 27, there are formed a plurality of ink channels from the ink supply holes 30*a* to the nozzles 28 via the common ink chambers 99, the apertures 52, the communication holes 51, the pressure chambers 10 and the through-holes 29. The ink introduced into the channel unit 27 from the buffer tank 48 via the ink supply holes 30*a* is temporarily stored in the common ink chambers 99. Then, the ink is supplied to the pressure chambers 10 via the apertures 52. The ink in each pressure chamber 10 which is pressurized by the piezoelectric actuator 21 is ejected from the corresponding nozzle 28 via the through-holes 29.

Figure 6:
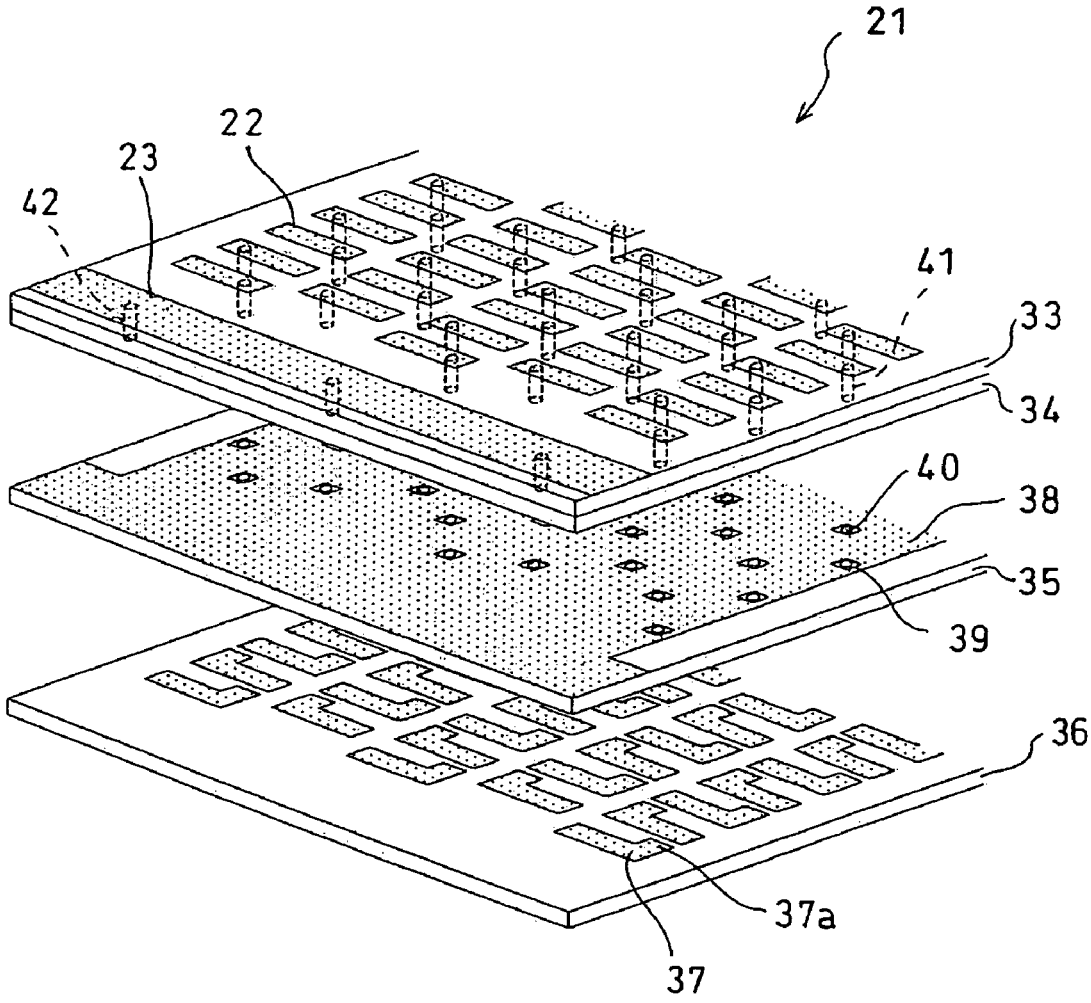
FIG. 6 is an exploded perspective view showing a principal part of a piezoelectric actuator shown in FIG. 5.

FIG. 6 is an exploded perspective view showing a principal portion of the piezoelectric actuator 21 of FIG. 5. The piezoelectric actuator 21 includes two insulating sheets 33, 34 and two piezoelectric sheets 35, 36, which sheets 33-36 are stacked on each other. On an upper surface of the piezoelectric sheet 36, the plurality of individual electrodes 37 are formed so as to correspond to the respective pressure chambers 10 of the channel unit 27. The individual electrodes 37 are arranged in five rows in a zigzag fashion along a longitudinal direction of the piezoelectric sheet 36 such that the rows of the individual electrodes 37 correspond to the rows of the pressure chambers 10. Each individual electrode 37 is generally elongate in a width direction of the piezoelectric sheet 36. Each individual electrode 37 has an extension 37*a* which is extended from one end thereof in the longitudinal direction of the piezoelectric sheet 36. The extensions 37*a* are extended to respective positions of the piezoelectric sheet 36 which respectively correspond to partition wall portions of the cavity plate 108 that define the pressure chambers 10.

On an upper surface of the piezoelectric sheet 35, the common electrode 38 is provided so as to cover the plurality of pressure chambers 10. The common electrode 38 is formed with a plurality of non-electrode regions 39 in which the piezoelectric sheet 35 is exposed. Within each non-electrode region 39, a hole 40 is formed through the thickness of the piezoelectric sheet 35. The non-electrode regions 39 are formed at respective locations at which the non-electrode regions 39 are opposed to the corresponding extensions 37*a* of the individual electrodes 37.

On an upper surface of the uppermost insulating sheet 33 (i.e., on the upper surface of the piezoelectric actuator 21), there are formed surface electrodes 22 which correspond to the respective individual electrodes 37 and a surface electrode 23 which corresponds to the common electrode 38. The surface electrodes 22 are located at respective positions of the insulating sheet 33 which respectively correspond to the partition wall portions of the cavity plate 108 that define the pressure chambers 10. The surface electrodes 22 are arranged in five rows in a zigzag fashion along the longitudinal direction of the piezoelectric actuator 21 so as to correspond to the respective individual electrodes 37. The surface electrode 23 is formed at one end of the insulating sheet 33 so as to extend in the width direction of the piezoelectric actuator 21.

A plurality of connection holes 41 are formed through the thickness of the insulating sheets 33, 34 at respective positions that correspond to the respective holes 40 in respective regions of the insulating sheets 33, 34 which are opposed to the corresponding surface electrodes 22 and extensions 37*a*. With the holes 40 and the connection holes 41 positioned relative to each other, the two insulating sheets 33, 34 and the piezoelectric sheet 35 are stacked on each other, whereby a plurality of through-holes are formed through the thickness of the upper three sheets 33-35 of the piezoelectric actuator 21. When the piezoelectric actuator 21 is manufactured, these through-holes are filled with an electrically conductive material for electrically connecting the surface electrodes 22 and the individual electrodes 37. In respective regions of the insulating sheets 33, 34 at which the surface electrode 23 is opposed to the common electrode 38, three connection holes 42 are formed through the thickness of the insulating sheets 33, 34 so as to be spaced apart from each other in the width direction of those two sheets 33, 34. When the piezoelectric actuator 21 is manufactured, the connection holes 42 are also filled with the electrically conductive material for electrically connecting the surface electrode 23 and the common electrode 38.

In the thus constructed piezoelectric actuator 21, the individual electrodes 37 are connected to the drive IC 80 via the respective surface electrodes 22 and the respective individual wires 73 while the common electrode 38 is connected to the ground via the surface electrode 23 and the common wire 75. According to the structure, it is possible to apply a drive voltage (drive signal) from the driver IC 80 to an arbitrary individual electrode 37. Thus, an active portion corresponding to a desired individual electrode 37 is arranged to undergo strain in the direction of stacking of the sheets 33-36 of the piezoelectric actuator 21, thereby ejecting ink from the nozzle 28 that corresponds to the individual electrode 37 in question for printing on the recording sheet.

Figure 7A:
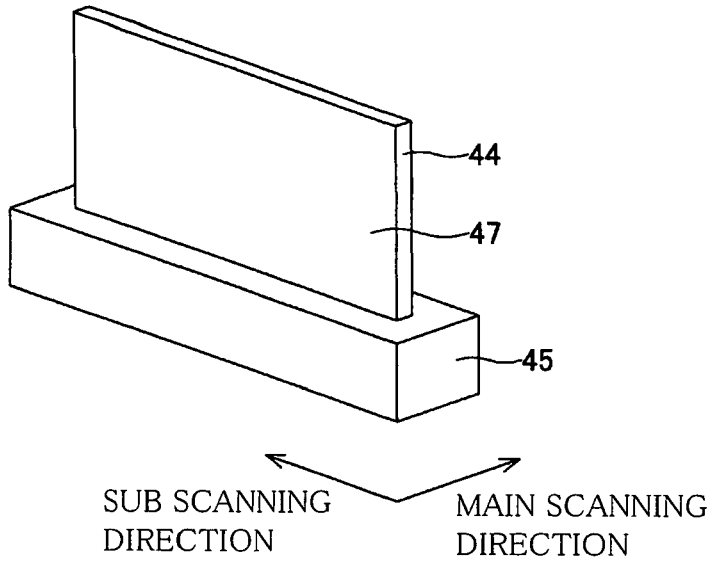
FIG. 7A is a perspective view schematically showing a cleaning blade according to the first embodiment of the invention and FIG. 7B is a front view of the cleaning blade.
Figure 7B:
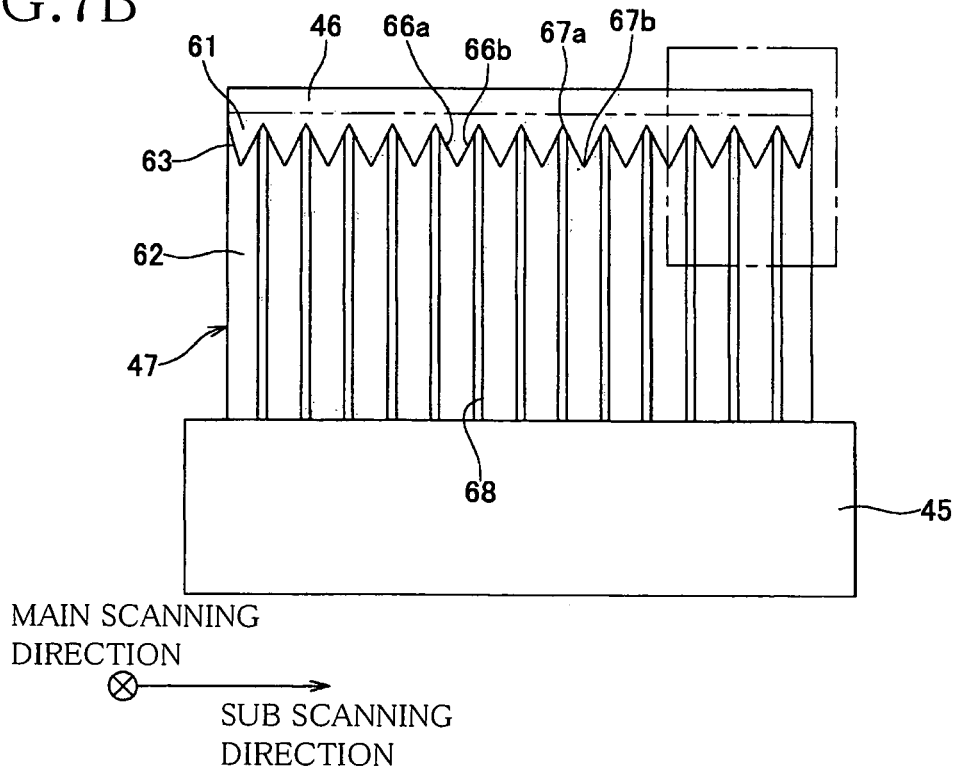

Referring to FIGS. 7A and 7B, the description will be made with respect to the cleaning blade 44 which is constructed according to a first embodiment of the invention and which wipes ink adhered to the ink ejection surface 25*a* as a result of the purging operation and the flushing operation of the ink-jet head 30.

The cleaning blade generally indicated at 44 in FIG. 7A is a generally flat plate extending in the vertical direction of FIG. 7A and in the sub scanning direction. The cleaning blade 44 is made of an elastic body such as an ethylene propylene rubber, a butyl rubber or a silicone rubber. At a lower end of the cleaning blade 44, there is provided an ink accommodating portion 45 having a rectangular parallelepiped shape for accommodating ink which has been wiped away from the ink ejection surface 25*a* by the cleaning blade 44.

As shown in FIG. 7B, the surface of the cleaning blade 44 is partially coated with two sorts of water-repellent films or membranes which are formed adjacent to each other, i.e., a first water-repellent film 61 and a second water-repellent film 62. The first and second water-repellent films 61, 62 have the same, uniform thickness. The first water-repellent film 61 is formed of polytetrafluoroethylene or fluoroethylene-propylene copolymer, for instance. The second water-repellent film 62 is formed of polyvinylidene fluoride or ethylene-tetrafluoroethylene copolymer, for instance. The first water-repellent film 61 has water repellency higher than that of the second water-repellent film 62. The first water-repellent film 61 is formed over a first region of the surface of the cleaning blade 44 which includes: a part of one side surface 47 of the blade 44 including (a) a contact portion 46 (i.e., an area ranging from the top end of the blade 44 to two-dot chain line in FIG. 7B) which is to be in contact with the ink ejection surface 25*a* while being made flexed; and (b) an area between the two-dot chain line in FIG. 7B and a boundary line 63 below the tow-dot chain line. The second water-repellent film 62 is formed over a second region which is the other part of the side surface 47 except the first region.

Figure 8:
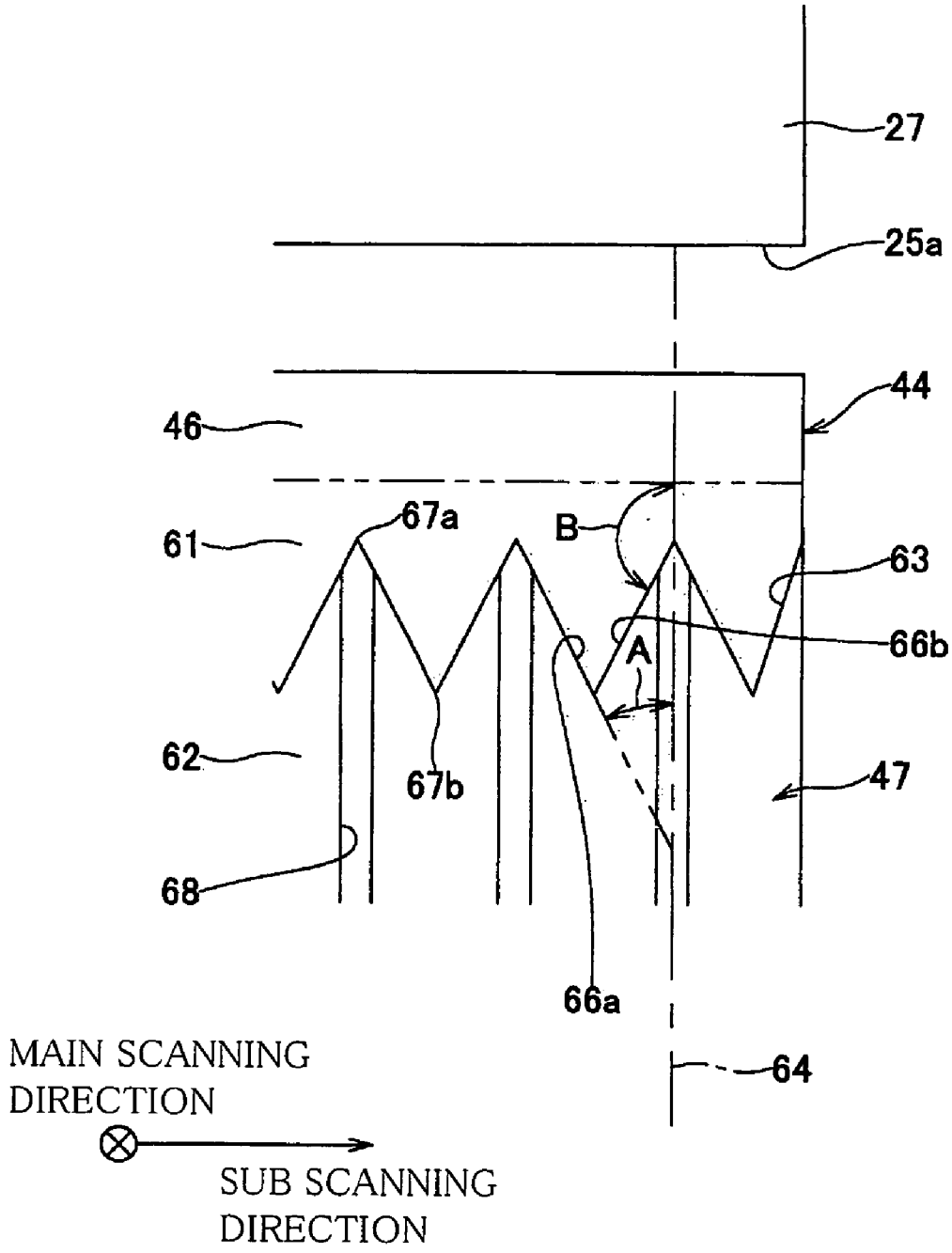
FIG. 8 is an enlarged side view of a portion in FIG. 7 enclosed by one-dot chain line.

The boundary line 63 which constitutes a boundary between the first region and the second region is in a corrugated or zigzag form and extends in the sub scanning direction in FIG. 7B. Namely, as shown in FIG. 8, the boundary line 63 is constituted by including oblique portions 66*a* and oblique portions 66*b* which are alternately disposed along the boundary in the side surface 47 (the blade surface) of the cleaning blade 44 on which the contact portion 46 is formed. Described more specifically, each oblique portion 66*a* makes an acute angle A with respect to a straight line 64 which is orthogonal to the ink ejection surface 25*a* and which connects the boundary line 63 and the contact portion 46 by the shortest distance, while each oblique portion 66*b* makes an obtuse angle with respect to the straight line 64. In other words, the boundary line 63 is constituted by a plurality of the oblique portions 66*a*, 66*b* which are continuously formed along the boundary such that any adjacent two of the oblique portions 66*a*, 66*b* are inclined in respective opposite directions with respect to the straight line 64. Both of the oblique portions 66*a* and the oblique portions 66*b* are linear and uniformly distributed along the boundary in the sub scanning direction. Because the boundary line 63 is constituted by the oblique portions 66*a*, 66*b* which are uniformly distributed and regularly disposed as described above, the design of the boundary line 63 is facilitated. Further, the ink transferred from the ink ejection surface 25*a* to the cleaning blade 44 as a result of the wiping operation by the blade 44 receives a uniform degree of force acting thereon such that the ink moves from the contact portion 46 toward the ink accommodating portion 45, owing to the boundary line 63 constituted by the uniformly distributed oblique portions 66, 66*b*. In the present embodiment, the first and second water-repellent films 61, 62 are formed, for instance, by a spray coating method in which the side surface 47 and the upper end surface (the top end surface) of the cleaning blade 44 are suitably sprayed with the materials for forming the first and second water-repellent films 61, 62, respectively. Described more specifically, a suitable masking member having a shape which corresponds to the shape of the second film 62 to be formed is applied to the side surface 47 of the cleaning blade 44. In this state, the material for the first water-repellent film 61 is sprayed on the upper end surface and the side surface 47 of the blade 44, thereby forming the first water-repellent film 61. Further, after having removed the making member, another masking member having a shape which corresponds to the shape of the first film 61 is applied to the thus formed first film 61. In this state, the material for the second water-repellent film 62 is sprayed on the side surface 47, thereby forming the second water-repellent film 62. The first and second water-repellent films 61, 62 may be formed otherwise. For instance, the films 61, 62 may be formed by a dipping method in which the blade 44 is suitably dipped in the materials for the respective two films 61, 62, thereby forming the two sorts of water-repellent films at appropriate regions of the blade 44. In the exemplary embodiment, while the first and second water-repellent films 61, 62 are formed only on one side surface 47 and the upper end surface of the blade 44, the films 61, 62 may be formed over the entire surface of the blade 44.

As shown in FIG. 7B and FIG. 8, a plurality of channels 68 are formed on the side surface 47 of the blade 44 such that the channels 68 extend in the vertical direction and are spaced apart from each other in the sub scanning direction. The oblique portions 66*a* and the oblique portions 66*b* are connected at connections (connecting points) 67*a*, 67*b*. The upper ends of the respective channels 68 are located at corresponding connections 67*a* which are located nearer to the top end of the blade 44. Each channel 68 is formed to extend from the corresponding connection 67*a* to the lower end of the blade 44. In other words, the plurality of channels 68 are formed across the second region in which the second water-repellent film 62 is formed. Each channel 68 linearly extends from the corresponding connection 67*a* on the boundary line 63 toward the ink accommodating portion 45. Because the water-repellent film 62 is formed, by the spray coating method, on the blade 44 in which the channels 68 are formed in advance, the film 62 exists in the respective channels 68.

By referring next to FIGS. 9A-9D showing the state of movement of the ink on the side surface 47 of the blade 44, there will be explained the movement of the ink on the side surface 47 of the blade 44 when the ink adhering to the ink ejection surface 25*a* is wiped by the blade 44 as a result of moving of the head unit 8, with the blade 44 held in contact with the ink ejection surface 25*a*. In each of FIGS. 9A-9D, a hatched area indicates the ink which has moved from the ink ejection surface 25*a* and attached to the blade 44 as a result of the wiping operation by the blade 44.

When the blade 44 and the ink ejection surface 25*a* start to move relative to each other with the contact portion 46 of the blade 44 held in contact with the ink ejection surface 25*a*, the ink adhering to the ink ejection surface 25*a* starts to deposit on the entirety of the contact portion 46. When the carriage motor 12 is driven to move the head unit 8 in the leftward direction in FIG. 1 and the head unit 8 is moved to a location where the ink ejection surface 25*a* and the blade 44 do not face each other (i.e., a location where the ink ejection surface 25*a* and blade 44 are out of contact), the ink which has been wiped away from the ink ejection surface 25*a* attaches to the entirety of the first water-repellent film 61 and then moves on the second water-repellent film 62 beyond the boundary line 63, as shown in FIG. 9B, for instance. The state of the movement of the ink changes from the state shown in FIG. 9B to the state shown in FIG. 9C. Thus, most of the ink attached to the contact portion 46 moves on a lower portion of the first water-repellent film 61 near the boundary line 63 and on the second water-repellent film 62. The movement of the ink described above is attributable to the following: The ink moves toward the lower end of the blade 44 by its own weight. Further, owing to the water repellency of the second film 62 lower than the first film 61, the ink on the first film 61 moves so as to be drawn toward the second water-repellent film 62 in the vicinity of the boundary line 63, especially in the vicinity of the connections 67*a*. Moreover, the ink in the vicinity of the channels 68 moves so as to be drawn into the channels 68 owing to the capillary force or action of the channels 68.

Figure 9A:
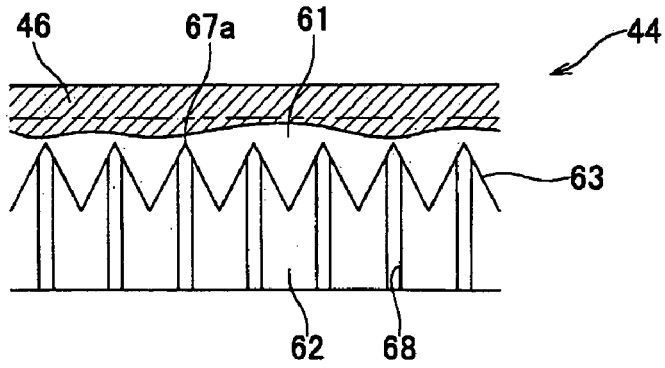
FIGS. 9A-9D are views showing the state of movement of the ink on one surface of the cleaning blade according to the first embodiment of the invention.
Figure 9B:
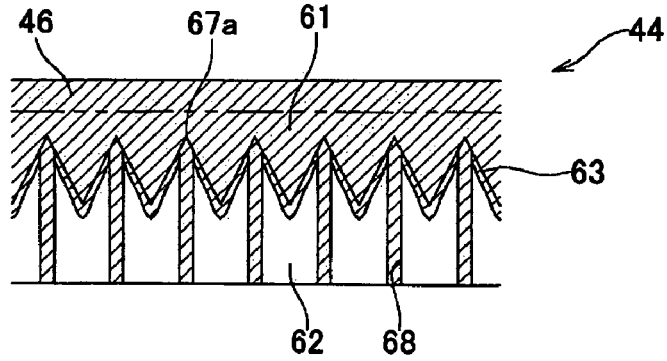
Figure 9C:
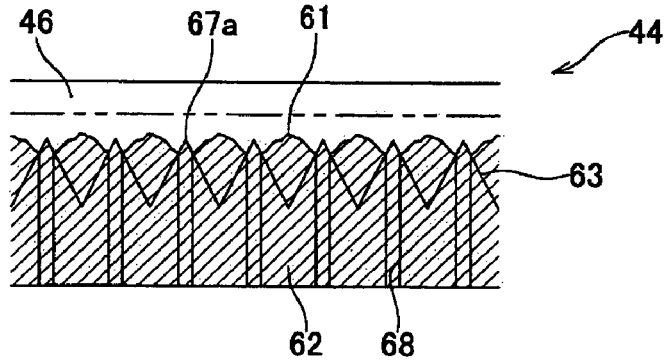
Figure 9D:
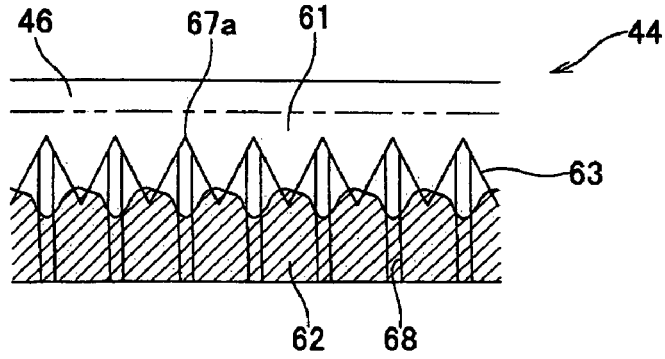

Here, the change of the sate of the movement of the ink from the state shown in FIG. 9A to the state shown in FIG. 9B initiates such that the movement of the ink by its own weight is assisted owing to the high degree of water repellency of the first film 61. Further, at portions on the boundary line 63 which protrude toward the contact portion 46 (i.e., in the vicinity of the connections 67*a* in the exemplary embodiment), the boundary line 63 is formed on opposite sides of the protruding portions, so that the ink moves toward the vicinity of the protruding portions (the connections 67*a*) from the opposite sides thereof so as to gather thereabout. Accordingly, the amount of the movement of the ink away from the contact portion 46 per unit length in the sub scanning direction is larger at the vicinity of the protruding portions than any other portions of the boundary line 63. Thus, the protruding portions function as a sort of suction or inlet port. In the exemplary embodiment in which the channels 68 are formed to extend from the respective connections 67*a* toward the ink accommodating portion 45, the ink moved from the opposite sides of each connection 67*a* is swiftly drawn or introduced into the corresponding channel 68, and further moves downward. In the meantime, the ink which exists between any adjacent two of the connections 67*a* and which is separated from each connection 67*a* partially moves toward the second water-repellent film 62 beyond the boundary line 63 while at the same time moves down to the vicinity of each connection 67*b*. Thus, the ink on the first water-repellent film 61 gradually moves on the second water-repellent film 62 beyond the boundary line 63. In this instance, because the boundary line 63 includes the plurality of oblique portions 66*a*, 66*b*, the length of the boundary line 63 is relatively long. Therefore, there are a lot of chances for the ink on the first water-repellent film 61 to contact the boundary line 63, so that the ink on the first film 61 comes into contact with and moves toward the second film 62 smoothly. Thus, the state of the movement of the ink shown in FIG. 9B changes to the state shown in FIG. 9C and then to the state shown in FIG. 9D in which most of the ink on the first water-repellent film 61 moves on the second water-repellent film 62. The ink moved on the second film 62 finally moves into the ink accommodating portion 45 disposed at the lower end of the cleaning blade 44.

In the ink-jet printer 1 which employs the cleaning blade 44 constructed according to the first embodiment explained above, the boundary line 63 which constitutes the boundary between the two water-repellent films 61, 62 is made longer on the side surface 47 of the blade 44 than a straight line that is parallel to the ink ejection surface 25*a*. According to the arrangement, the ink which has been wiped away from the ink ejection surface 25*a* and adhered to the blade 44 as a result of the wiping operation by the blade 44 tends to easily move from the first water-repellent film 61 to the second water-repellent film 62 owing to increased chances of contact with the second film 62, whereby the ink which has been wiped away from the ink ejection surface 25*a* and adhered to the blade 44 is not likely to remain on the first region on which the first water-repellent film 61 is formed and which includes the contact portion 46. As a result, there is substantially no fear that the ink remains on the first film 61 which is also formed on the contact portion 46, thereby avoiding solidification and thickening of the ink due to drying on the first film 61. Therefore, when the blade 44 subsequently wipes over the ink ejection surface 25*a*, it is possible to prevent attachment or adhesion of solidified or thickened ink to the ink ejection surface 25*a*.

In the illustrated first embodiment wherein the oblique portions 66*a*, 66*b* of the boundary line 63 are alternately arranged and uniformly distributed along the straight line parallel to the plane of the ink ejection surface 25*a*, the ink adhering to the water-repellent film 61 is likely to move owing to the second water-repellent film 62 and the amount of the ink which moves from the first film 61 to the second film 62 is uniform at any position on the boundary line 63. Namely, on a boundary line in which the oblique portions 66*a*, 66*b* are not uniformly distributed as compared with the boundary line 63 of the exemplary embodiment, the amount of the movement of the ink adhering to the blade varies with respect to the sub scanning direction. In contrast, the amount of the movement of the ink hardly varies at any position on the boundary line 63 which is configured according to the present embodiment.

In the second region of the surface of the blade 44 in which the second water-repellent film 62 is formed, the channels 68 are formed to extend downward from the respective connections 67*a*. As the opening width of each channel 68 is very small, the ink which is about to reach the upper end of each channel 68 is drawn thereinto owing to the capillary force or action of the same 68, whereby the ink on the first film 61 tends to easily move into the channels 68 on the side of the second film 62, at the vicinity of the connections 67*a* which are the nearest to the top end of the blade 44 on the boundary line 63. Therefore, the ink is swiftly removed from the vicinity of the top end of the blade 44 and hardly remains thereupon. Accordingly, when the blade 44 subsequently wipes over the ink ejection surface 25*a*, it is possible to prevent solidified or thickened ink from adhering back to the ink ejection surface 25*a*.

Figure 10:
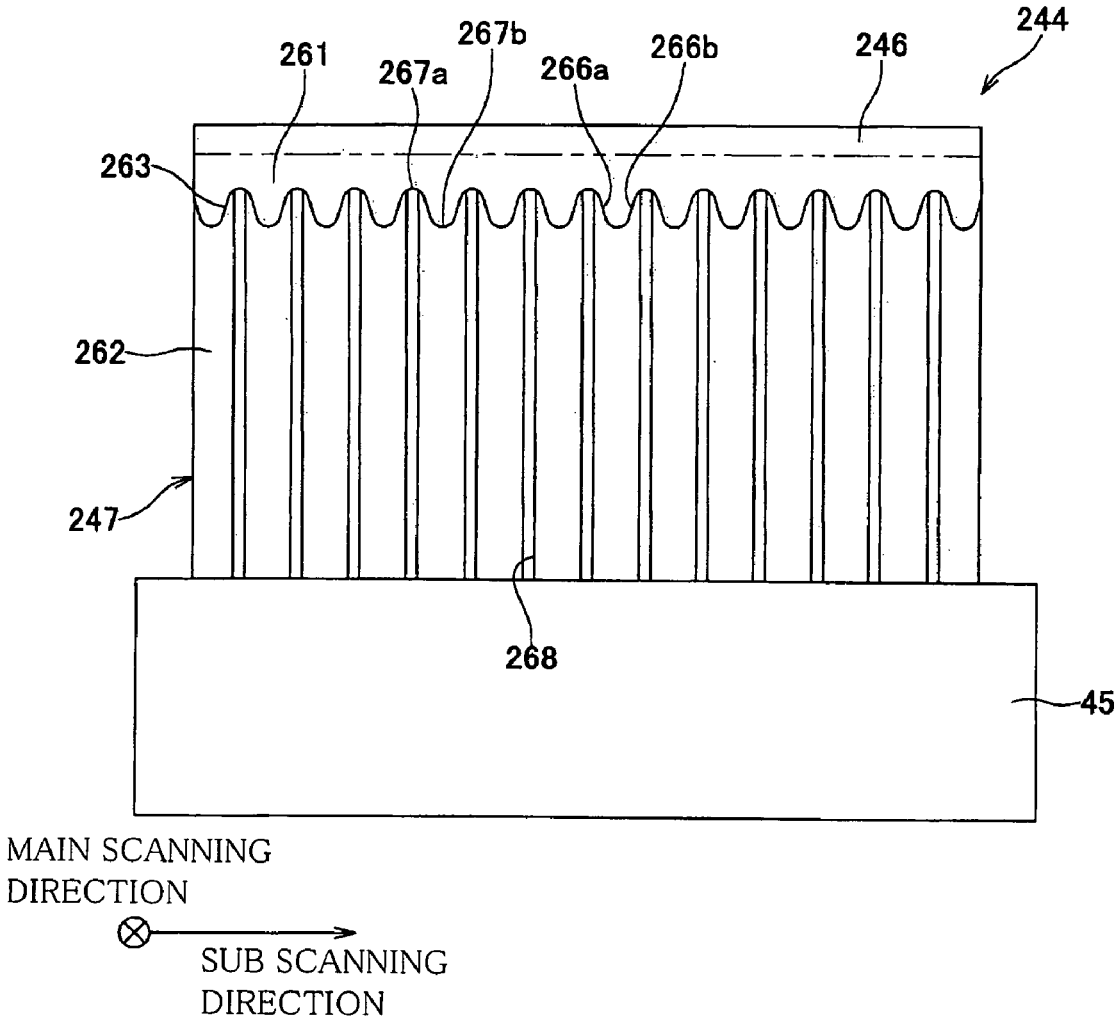
FIG. 10 is a front view of a cleaning blade according to a second embodiment of the invention.

There will be next explained an ink-jet printer which employs a cleaning blade constructed according to a second embodiment of the invention by referring to the front view of the blade of FIG. 10. The ink-jet printer in the second exemplary embodiment is identical in construction with the ink-jet printer in the first exemplary embodiment except that the blade 44 is replaced with a blade 244 shown in FIG. 10. As shown in FIG. 10, the ink accommodating portion 45 is disposed at the lower end of the blade 244. While the blade 244 is substantially identical with the blade 44 in construction, shape and material, the blade 244 slightly differs from the blade 44 in the configuration of a boundary line 263 that constitutes a boundary between a first water-repellent film 26*a* and a second water-repellent film 262. The first and second water-repellent films 261, 262 are formed of the same materials for the first and second water-repellent films 61, 62, respectively. Therefore, the first film 261 has a higher degree of water repellency than the second film 262. The boundary line 263 of the blade 244 has a corrugated or wavy shape extending in the sub scanning direction on one side surface 247 of the blade 244 (blade surface). For instance, the boundary line 263 is in a sine curve form. As the boundary line 263 is constituted by the sine curve, the design of the boundary line 263 is facilitated. As in the illustrated first embodiment, the first and second water-repellent films 261, 262 are formed by the spray coating method. Described in detail, a suitable masking member having a shape of the second film 262 to be formed is applied to the side surface 247. In this state, the material for the first water-repellent film 261 is sprayed over the side surface 247, thereby forming the first water-repellent film 261. Then, after having removed the masking member, another masking member having a shape of the first film 261 is applied to the thus formed first film 261. In this state, the material for the second film 262 is sprayed over the side surface 247, thereby forming the second water-repellent film 262.

The boundary line 263 has a plurality of oblique portions 266*a*, 266*b* corresponding to the oblique portions 66*a*, 66*b*. The oblique portions 266*a*, 266*b* are alternately arranged along the sub scanning direction and are connected to each other by connections 267*a*, 267*b*. On the side surface 247 of the blade 244, there are formed a plurality of channels 268 similar to the channels 68 described above so as to be spaced apart from each other in the sub scanning direction. Each of the channels 268 has an upper end that is located at the corresponding connection 267*a* and extends from the connection 267*a* to the lower end of the blade 244.

By referring next to FIGS. 11A-11D showing the state of movement of the ink on the side surface 247 of the blade 244, there will be explained the movement of the ink on the side surface 247 of the blade 244 when the ink adhering to the ink ejection surface 25*a* is wiped by the blade 244 as a result of moving of the head unit 8, with the blade 244 held in contact with the ink ejection surface 25*a*. In each of FIGS. 11A-11D, a hatched area indicates the ink moved from the ink ejection surface 25*a* and attached to the blade 244 as a result of the wiping operation by the blade 244.

When the blade 244 and the ink ejection surface 25*a* start to move relative to each other with a contact portion 246 of the blade 244 held in contact with the ink ejection surface 25*a*, the ink adhering to the ink ejection surface 25*a* start to deposit on the entirety of the contact portion 246. When the carriage motor 12 is driven to move the head unit 8 and the wiping operation performed by the blade 244 is terminated, the ink attaches to the entirety of the first water-repellent film 261 and then moves on the second water-repellent film 262 beyond the boundary line 263, as shown in FIG. 11B, for instance. The state of the movement of the ink changes from the state shown in FIG. 11B to the state shown in FIG. 11C. Thus, most of the ink attached to the contact portion 246 moves on a lower portion of the first water-repellent film 261 near the boundary line 263 and on the second water-repellent film 262. As in the illustrated first embodiment, the movement of the ink described above is attributable to the following: The ink moves toward the lower end of the blade 244 by its own weight. Further, owing to the water repellency of the second film 262 lower than the first film 261, the ink on the first film 261 moves so as to be drawn toward the second film 262 in the vicinity of the boundary line 263. Moreover, the ink in the vicinity of the channels 268 moves to be drawn into the channels 268 owing to the capillary force or action thereof.

Figure 11A:
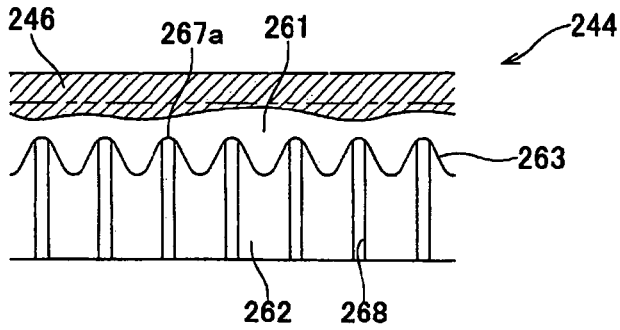
FIGS. 11A-11D are views showing the state of movement of the ink on one surface of the cleaning blade according to the second embodiment of the invention.
Figure 11B:
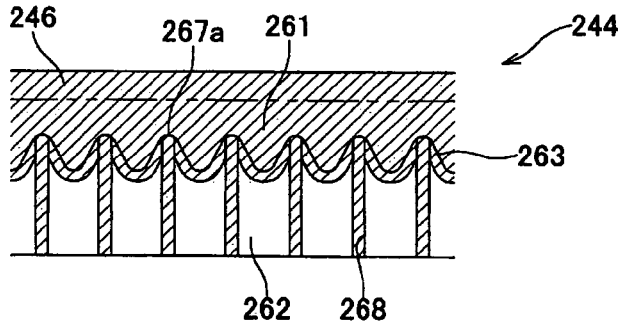
Figure 11C:
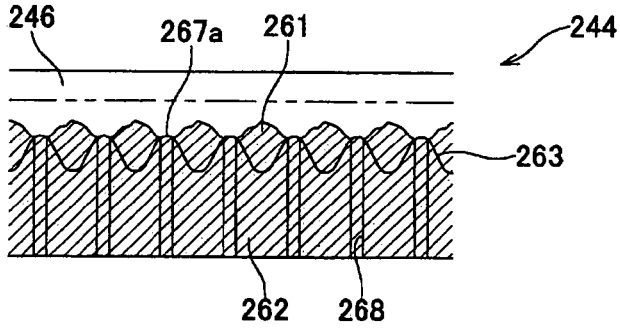
Figure 11D:
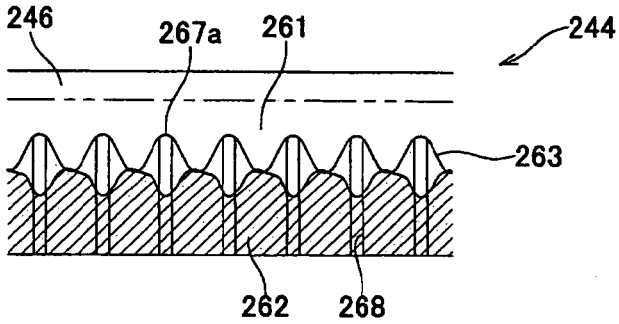

The change of the movement of the ink from the state shown in FIG. 11A to the state shown in FIG. 11 via the state shown in FIG. 11B is similar to that in the illustrated first embodiment. In this instance, because the boundary line 263 includes the plurality of curved oblique portions 266*a*, 266*b*, the length of the boundary line 263 is made longer than that of the boundary line 63. Therefore, there are more chances in the second exemplary embodiment that the ink on the first water-repellent film 261 in the vicinity of the boundary line 263 comes into contact with the boundary line 263 than in the illustrated first embodiment, so that the ink on the first film 261 comes into contact with and moves toward the second film 262 smoothly. Thus, the state of the movement of the ink shown in FIG. 11B changes to the state shown in FIG. 11C and then to the state shown in FIG. 11D in which most of the ink on the first water-repellent film 261 moves on the second water-repellent film 262. The ink moved onto the second film 262 finally moves into the ink accommodating portion 45 disposed at the lower end of the cleaning blade 244.

As explained above, in the ink-jet printer which employs the blade 244 constructed according to the second embodiment, the boundary line 263 has a length larger than that of the boundary line 63 in the illustrated first embodiment. According to the arrangement, the ink which has been wiped away from the ink ejection surface 25*a* and adhered to the blade 244 tends to easily move to the second film 262. Accordingly, the ink which has been wiped away from the ink ejection surface 25*a* and adhered to the blade 244 hardly remains on the first region of the surface of the blade 244 on which the first water-repellent film 261 is formed and which includes the contact portion 246 of the blade 244. In consequence, there is substantially no fear that the ink remains on the first film 261 which is also formed on the contact portion 246, thereby avoiding solidification and thickening of the ink due to drying on the first film 261. Therefore, it is possible to prevent solidified or thickened ink from attaching to the ink ejection surface 25*a*. Further, the provision of the channels 268 assures advantages similar to those assured by the provision of the channels 68 in the illustrated first embodiment.

While the preferred embodiments of the present invention have been described in detail by reference to the drawings, it is to be understood that the present invention may be otherwise embodied.

The oblique portions 66*a*, 66*b*, 266*a*, 266*b* may not be arranged alternately in the sub scanning direction. Further, the oblique portions 66*a*, 66*b*, 266*a*, 266*b* may not be uniformly distributed. Namely, the boundary line 63, 263 of the blade 44, 244 may be a straight line or a curved line which makes an acute angle or an obtuse angle with respect to the straight line 64 indicated above. In this instance, too, the boundary line is made longer than a straight line which forms a right angle with respect to the straight line 64. Accordingly, the ink wiped by the blade is less likely to remain on the contact portion of the blade. The oblique portions may have a bent configuration as well as the sine curve configuration, so that the ink existing near the contact portion 46, 246 easily moves in a direction away therefrom.

In the illustrated first and second embodiments, the blade surfaces of the respective blades 44, 244 are partially covered with the first and second water-repellent films 61, 62 and the first and second water-repellent films 261, 262, respectively. The blade may be constituted by two types of elastic members having mutually different degrees of water repellency, which elastic members are bonded to each other such that one of the two elastic members having a higher degree of water repellency is disposed at a top end side of the blade while the other elastic member having a lower degree of water repellency is disposed at a proximal end side of the blade. In this case, where a boundary line between the two elastic members is made longer than the straight line that is parallel to the ink ejection surface like the boundary lines 63, 263, the advantages similar to those described above with respect to the boundary lines 63, 263 can be obtained. Where the water repellency of the surface of the base material or member of each blade 44, 244 is lower than that of the first water-repellent film 61, 261, the second water-repellent film 62, 262 may be eliminated. In this instance, the boundary line between the surface of the base material or member of each blade 44, 244 and the first water-repellent film 61, 261 corresponds to the above-indicated boundary line 63, 263. On the contrary, where the water repellency of the surface of the base material or member of each blade 44, 244 is higher than that of the second water-repellent film 62, 262, the first water-repellent film 61, 261 may be eliminated. In this instance, the boundary line between the surface of the base material or member of each blade 44, 244 and the second water-repellent film 62, 262 corresponds to the above-indicated boundary line 63, 263.

Each channel 68, 268 formed in the second region in which the second water-repellent film 62, 262 of each blade 44, 244 is formed may extend in a diagonally downward direction toward the lower end of each blade 44, 244. Moreover, each channel 68, 268 which linearly extends in the illustrated embodiments may be curved. In the surface of the blade according to the present invention, there may be formed channels at positions on the boundary line at each of which a distance from the ink ejection surface 25*a* is maximal, i.e., at positions on the boundary line each of which is the farthest from the top end of the blade, such that each channel crosses the second region, namely, the second water-repellent film 62, 262. In this arrangement, the movement of the ink passing over the boundary line is promoted. Such channels may be combined with the channels 68, 268, thereby assuring more enhanced effect. The channels 68, 268 may be formed in the respective blades 44, 244 after the respective second water-repellent films 62, 262 have been formed. In this case, no water-repellent films are formed within the channels 68, 268.

In the illustrated first and second embodiments, the first water-repellent films 61, 261 are formed of the material different from the material for the second water-repellent films 62, 262. The first water-repellent films 61, 62 and the second water-repellent films 261, 262 may be made of the same material. In this instance, it is preferable that the thickness of the second water-repellent films 62, 262 be made smaller than the thickness of the first water-repellent films 61, 261 for permitting the second films 62, 262 to have a lower degree of water repellency than the first films 61, 261. This arrangement needs only one masking member to be used. The boundary line in the present invention extends at least over an area corresponding to the ink ejection surface provided by the rows of the nozzles 28. For assuring more reliable movement of the ink on the blade while preventing remaining of the ink on the blade, it is preferable that the boundary line extend over an area larger than the width of the ink ejection surface provided by the rows of the nozzles 28. To this end, the width of the blade in the sub scanning direction may be made either larger or smaller than the width of the nozzle plate in the sub scanning direction.

The head of the ink-jet printer 1 in each of the illustrated embodiments is of a serial type in which the head moves in a state in which the blade and the ink ejection surface are held in contact with each other, whereby the ink adhered to the ink ejection surface is wiped by the blade. The principle of the invention may be applicable to a head of a line type. In this case, since the head is fixedly positioned, the blade is arranged to move in a direction parallel to the plane of the ink ejection surface, with the blade held in contact with the ink ejection surface, whereby the ink adhered to the ink ejection surface is wiped. The blades according to the present invention can be used in the ink-jet printer which employs either of the line-type head or the serial-type head. The ink-jet head in each of the illustrated embodiments is arranged to be driven by the piezoelectric actuator for thereby ejecting the ink from the nozzles. The principle of the invention may be applicable to an ink-jet head of a thermal type in which the ink in each pressure chamber is heated by a drive signal sent from the FPC, thereby giving ejection energy to the ink in each pressure chamber.

It is to be understood that the present invention may be embodied with various other changes and modifications, which may occur to those skilled in the art, without departing from the spirit and scope of the invention defined in the appended claims.

What is claimed is:

1. A cleaning blade for wiping ink adhering to an ink ejection surface of an ink-jet head in which nozzles are formed by a relative movement of the cleaning blade and the ink ejection surface with the cleaning blade held in contact with the ink ejection surface, wherein the cleaning blade has a surface having: a first region which is located near to the ink ejection surface and which has a first degree of water repellency; and a second region which is contiguous to the first region and located away from the ink ejection surface and which has a second degree of water repellency that is lower than the first degree of water repellency, and wherein a boundary line which constitutes a boundary between the first region and the second region has at least one oblique portion each of which is inclined with respect to a straight line that is orthogonal to the ink ejection surface.

2. The cleaning blade according to claim 1, wherein the at least one oblique portion comprise a plurality of oblique portions which are uniformly distributed along the boundary.

3. The cleaning blade according to claim 1, wherein the boundary line is corrugated, so that the at least one oblique portion comprises a plurality of oblique portions.

4. The cleaning blade according to claim 1, wherein the at least one oblique portion comprises a plurality of oblique portions, and wherein the boundary line is constituted by the plurality of oblique portions which are continuously formed along the boundary such that any adjacent two of the plurality of oblique portions are inclined in respective opposite directions with respect to the straight line that is orthogonal to the ink ejection surface.

5. The cleaning blade according to claim 1, wherein each of the at least one oblique portion is in a linear form.

6. The cleaning blade according to claim 1, wherein each of the at least one oblique portion is in a curved form.

7. The cleaning blade according to claim 6, wherein each of the at least one oblique portion is in a sine curve form.

8. The cleaning blade according to claim 1, having, in the second region, at least one channel each of which extends in a direction away from the first region.

9. The cleaning blade according to claim 8, wherein the boundary line is corrugated, so that at least one oblique portion comprises a plurality of oblique portions, wherein the at least one channel comprises a plurality of channels which are formed to extend from respective points on the boundary line each of which is located at a position where a distance from the ink ejection surface is minimal.

10. An ink--et recording apparatus, comprising:

an ink-jet head having an ink ejection surface in which are formed nozzles for ejecting ink; and a cleaning device which wipes ink adhering to the ink ejection surface of the ink-jet head and which includes: a cleaning blade arranged to come into contact with the ink ejection surface; and a moving mechanism which moves the cleaning blade and the ink ejection surface relative to each other in a state in which the cleaning blade and the ink ejecting surface are held in contact with each other, wherein the cleaning blade has a surface having: a first region which is located near to the ink ejection surface and which has a first degree of water repellency; and a second region which is contiguous to the first region and located away from the ink ejection surface and which has a second degree of water repellency that is lower than the first degree of water repellency, and wherein a boundary line which constitutes a boundary between the first region and the second region has at least one oblique portion each of which is inclined with respect to a straight line that is orthogonal to the ink ejection surface.

* * * * *